United States Patent [19]

Clancey

[11] 4,239,422

[45] Dec. 16, 1980

[54] FLUSHING FLUID FOR CENTRIFUGAL PUMPS USED IN THE PIPELINING OF SLURRIES

[75] Inventor: James T. Clancey, Pittsburgh, Pa.

[73] Assignee: Conoco, Inc., Stamford, Conn.

[21] Appl. No.: 81,749

[22] Filed: Oct. 4, 1979

[51] Int. Cl.[3] ..... B65G 53/30

[52] U.S. Cl. ..... 406/47; 277/3; 277/68; 406/97; 406/104; 415/112; 415/116

[58] Field of Search ..... 406/47, 48, 97, 99, 406/100, 101, 104, 197; 415/110, 111, 112, 116; 277/3, 15, 59, 68

[56] References Cited

U.S. PATENT DOCUMENTS

| | | | |
|---|---|---|---|
| 2,332,150 | 10/1943 | Huff | 415/112 X |
| 2,624,599 | 1/1953 | Eaton | 415/112 X |
| 2,920,923 | 1/1960 | Wasp et al. | 406/47 |

*Primary Examiner*—Jeffrey V. Nase

*Attorney, Agent, or Firm*—F. Lindsey Scott; William A. Mikesell, Jr.

[57] ABSTRACT

In methods for transporting an aqueous slurry of particulate solids in a pipeline wherein the aqueous slurry has an effective viscosity greater than water and is pumped through the pipeline by at least one centrifugal pump wherein a flushing fluid is used to maintain the bearing surfaces in the centrifugal pump free of particulate solids, an improvement comprising; the use of a thickened aqueous flushing fluid having a viscosity equal to at least about 80 percent of the viscosity of the aqueous slurry.

6 Claims, 2 Drawing Figures

FLUSHING FLUID FOR CENTRIFUGAL PUMPS USED IN THE PIPELINING OF SLURRIES

This invention to the pipelining of particulate solids.

This invention more particularly relates to the transportation of aqueous slurries of particulate solids in pipelines wherein centrifugal pumps are used.

In the transportation of aqueous slurries comprising particulate solids in water in pipelines, it has long been known that the use of centrifugal pumps is desirable in some instances. It is necessary when centrifugal pumps are used in such applications that the bearing surfaces in the centrifugal pumps, in particular the surfaces closely contacting the drive shaft and the like, be protected from contact with the particulate solids contained in the aqueous slurry. Such is normally done by the use of flushing fluids which are allowed to bleed through the packing which bears the shafts to a slight extent thereby resulting in a continual flushing action whereby the particulate solids are flushed from the packing. The use of centrifugal pumps result in the bleeding of substantial amounts of liquid into the aqueous slurry with the resultant disadvantage of inconsistent slurry composition when pipeline transportation over long distances is contemplated. Such disadvantages and difficulties are discussed in some detail in U.S. Pat. No. 2,920,923 which is hereby incorporated by reference.

It has been found that the disadvantages of high volumes of water flow into the aqueous slurry and the problem of particulate solids deposition in the packing are reduced to a substantial extent by an improvement which comprises the use of a thickened aqueous flushing fluid as a bleed stream through the packing to prevent the deposition of particulate solids in the packing and to minimize both the amount of aqueous fluid which is bled into the aqueous slurry and the dilution effects of the fluid as mixed with the aqueous slurry.

Figure 1:
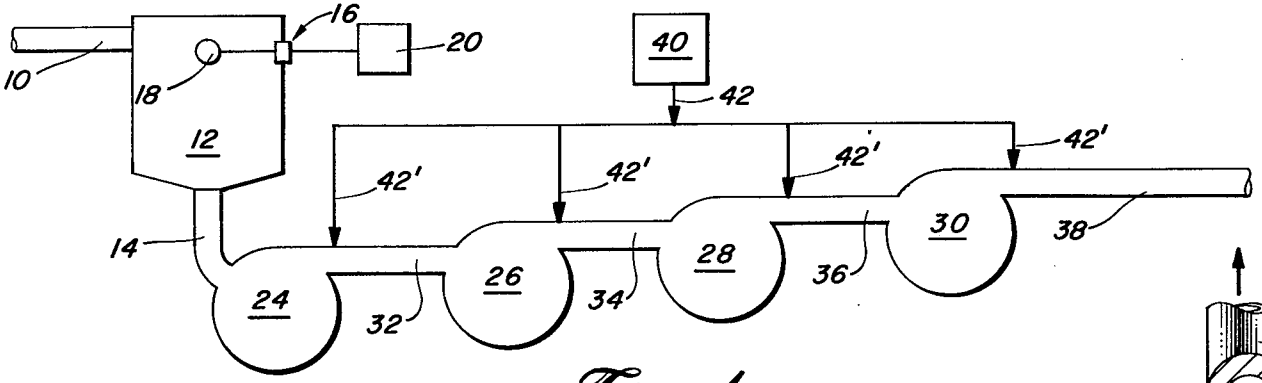
Figure 2:
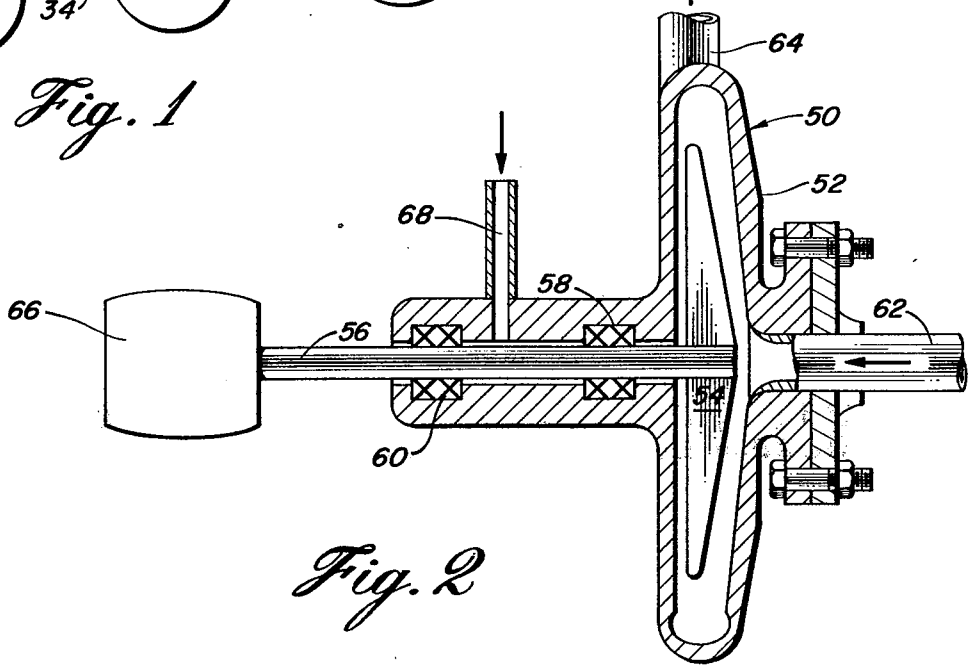

FIG. 1 is a schematic diagram of a pumping station using centrifugal pumps in the operation of a pipeline wherein aqueous slurries of particulate solids are transported; and, FIG. 2 is a cross sectional schematic view of a centrifugal pump showing the use of a bleed stream to prevent the deposition of particulate solids in the packing used in the centrifugal pump.

In FIG. 1 a pipeline 10 is shown wherein an aqueous slurry of particulate solids is transported. The flow through the pipeline is discharged into a surge tank 12 which includes a level controller generally designated 16 which is shown for illustrative purposes as a float 18 connected to a controller 20 for maintaining the level in surge tank 12 at a desired level. An outlet 14 fluidly communicates surge tank 12 and the inlet of a first centrifugal pump 24 which pumps aqueous slurry from surge tank 12 and feeds a second centrifugal pump 26 through a line 32 with second centrifugal pump 26 feeding a third centrifugal pump 28 through a line 34 with third centrifugal pump 28 feeding a fourth centrifugal pump 30 through a line 36. Fourth centrifugal pump 30 discharges to a continuing pipeline 38. As is well known to those skilled in the art a plurality of centrifugal pumps may be used in such pumping stations to achieve a greater pressure increase than is accomplished with one centrifugal pump. Such variations are well known to those skilled in the art and form no part of the present invention. A flushing fluid storage is shown as a tank 40 which includes a line 42 for discharging flushing fluid to each of the centrifugal pump through a plurality of distribution lines 42'.

In the operation of such pumping stations, the flushing fluid would normally be maintained under a given pressure in contact with the centrifugal pump packing nearest the aqueous slurry. The pressure maintained is normally slightly greater than that in the pumping area so that any flow of fluid through the packing is into the aqueous slurry. As indicated previously, even when such flushing arrangements are used it has been found that as a result of the high viscosity of the aqueous slurry and the like, particulate solids tend to be deposited in the packing of the centrifugal pumps thus resulting in increased wear on the pump shafts and the like.

FIG. 2 shows a centrifugal pump 50 comprising a pump housing 52 which includes an impeller 54 mounted on a shaft 56 which is positioned in housing 52 through an inner packing 58 and an outer packing 60. Aqueous slurry flows into pump 50 axially through an inlet 62 and outward through an outlet 64 as known to those skilled in the art. Pump 50 is driven by a motor 66 and a line 68 is provided for introducing a flushing fluid into the space between shaft 56 and housing 52 at a pressure greater than that in the pumping zone so that fluid is continually bled through inner packing 58 to mingle with the aqueous slurry.

In the use of such centrifugal pumps, it is noted that as shown in FIG. 1 a plurality of pumps are used in many instances and as the packing wears and the like with the constant pressure imposed on the flushing fluid, it has been found that substantial quantities of flushing fluid may be introduced into the aqueous slurry at a given pumping station. As discussed in U.S. Pat. No. 2,920,923 the introduction of substantial slugs of liquid having a different viscosity than the flowing aqueous slurry presents substantial problems in the long distance transportation of aqueous slurries of particulate solids. It is clear therefore that both to minimize the wear on pump shafts and the like and to prevent deterioration of the pipeline operation, it is necessary that the amount of flushing fluid injected be minimized. It has been found that such an objective is accomplished by adding a thickening agent to the flushing fluid. Desirably the thickening agent is selected from the group consisting of carboxymethylcellulose, gelatin, soluble starch, bone glue, polysaccharides, natural gums, artificial gums, water soluble partially hydrolyzed polyacrylamide polymers and water soluble copolymers of acrylamide with up to about 15 weight percent of other polymerizable vinyl compounds such as styrene, vinyl acetate, acrylonitrile, vinyl alkyl ethers, vinyl chloride, vinylidene chloride, methacrylamide and alkyl esters of acrylic and methacrylic acids and the like. The preparation and use of such thickened aqueous solutions in oil field applications is discussed in U.S. Pat. No. 3,770,056, which is hereby incorporated by reference. Desirably the thickening agent is added in an amount sufficient to increase the viscosity of the flushing fluid to a value equal to at least 80 percent of the viscosity of the aqueous slurry although it is highly desirable that the viscosity of the flushing fluid equal or exceed the viscosity of the aqueous slurry. Typically the viscosity of the aqueous slurry may be as high as 50 centipoise and it is desirable that the flushing fluid have a viscosity at least equal to that of the flowing aqueous slurry. Particularly desirable results have been accomplished wherein the thickening agent is carboxymethylcellulose and carboxymethylcellulose is preferred. An application in which the improvement of the present invention is particularly effective is in the slurry pipeline transportation of coal solids.

It has been found that the preparation of a thickened flushing fluid using carboxymethylcellulose which has a viscosity of approximately 50 centipoises is accomplished by dissolving up to about 1.4 weight percent carboxymethylcellulose in water, the weight percent carboxymethylcellulose being based upon the weight of the thickened flushing fluid so produced.

By the improvement of the present invention the amount of thickened flushing fluid which is bled through the packing is reduced, its effectiveness in preventing the deposition of particulate solids in the packing is increased and the effect of the thickened flushing fluid in the pipeline is minimized. In particular, the viscosity of the thickened flushing fluid is now roughly the same as that of the flowing aqueous slurry and the tendency for the composition of the aqueous slurry to vary as it passes along the length of the pipeline as occurs when quantities of liquids of varying viscosities are present is eliminated. Thus it is seen that by the improvement of the present invention, the effectiveness of the flushing fluid is increased and the detrimental effects resulting from the admixing of the flushing fluid with the flowing aqueous slurry are greatly reduced. Accordingly, the effectiveness of centrifugal pumps in the transportation of aqueous slurries has been greatly increased.

Having thus described the present invention by reference to certain of its preferred embodiments it is pointed out that the embodiments described are illustrative rather than limiting in nature and that many variations and modifications are possible within the scope of the present invention. Many such variations and modifications may be considered obvious and desirable by those skilled in the art upon a review of the foregoing description of preferred embodiments.

Having thus described the invention, I claim:

1. In a method for transporting an aqueous slurry of particulate solids in a pipeline wherein said aqueous slurry has an effective viscosity greater than water and is pumped through said pipeline by at least one centrifugal pump wherein a flushing fluid is used to maintain the bearing surfaces in said centrifugal pump substantially free of said particulate solids, the improvement comprising: the use of a thickened aqueous flushing fluid, said thickened aqueous flushing fluid consisting essentially of an aqueous solution and a thickening agent in an amount sufficient to increase the viscosity of said thickened aqueous flushing fluid to at least about 80 percent of the viscosity of said aqueous slurry.

2. The improvement of claim 1 wherein said thickening agent is selected from the group consisting of carboxymethylcellulose, gelatin, soluble starch, bone glue, polysaccharides, natural gums, artificial gums, water soluble partially hydrolyzed polyacrylamide polymers and water soluble copolymers of acrylamide with up to about 15 weight percent of other polymerizable vinyl compounds such as styrene, vinyl acetate, acrylonitrile, vinyl alkyl ethers, vinyl chloride, vinylidene chloride, methacrylamide and alkyl esters of acrylic and methacrylic acids.

3. The improvement of claim 2 wherein said thickening agent is carboxymethylcellulose.

4. The improvement of claim 1 wherein the viscosity of said thickened aqueous flushing fluid is adjusted to a value greater than that of said aqueous slurry.

5. The improvement of claim 1 wherein said thickening agent is carboxymethylcellulose and wherein said carboxymethylcellulose is present in an amount up to about 1.4 weight percent based on the weight of said thickened flushing fluid.

6. The improvement of claim 1 wherein a plurality of centrifugal pumps are used.

* * * * *